United States Patent [19]

Ooba

[11] B 4,076,261

[45] Feb. 28, 1978

[54] APEX SEAL DEVICE FOR USE IN ROTARY PISTON ENGINE

[75] Inventor: Yasumi Ooba, Toyota, Japan

[21] Appl. No.: 515,216

[22] Filed: Oct. 16, 1974

[73] Assignee: Toyota Jidosha Kogyo Kabushiki Kaisha, Toyota, Japan

[44] Published under the second Trial Voluntary Protest Program on February 17, 1976 as document No. B 515,216.

[30] Foreign Application Priority Data

Mar. 28, 1974 Japan ..... 49-35734[U]

[51] Int. Cl.[2] ..... F16J 15/48

[52] U.S. Cl. ..... 277/81 P; 418/122

[58] Field of Search ..... 418/122, 123; 277/81 P

[56] References Cited

U.S. PATENT DOCUMENTS 3,118,595 1/1964 Fuhrmann ..... 418/122

*Primary Examiner*—Robert I. Smith

[57] ABSTRACT

An apex seal device includes an apex seal fitted in an apex seal groove defined in a crest portion of a rotor and an apex seal spring confined between the bottom surface of the apex seal groove and the bottom surface of the apex seal, the bottom surface of the apex seal being so inclined to the horizontal line in its cross section parallel with the rotating plane of the rotor that a component of a force exerted by said spring in the direction perpendicular to the radial center line of the apex seal is directed opposite to the rotating direction of the rotor. Thus, the apex seal is biased against the radially extending wall surface of the apex seal groove on the side opposite to the rotating direction of the rotor, leaving a sufficient clearance between the radially extending wall surface of the apex seal groove opposing to the firstly referred wall surface thereof and the side surface of the apex seal to introduce a combustion gas pressure through said clearance so as to cause said pressure to act on the inclined bottom of said seal groove. This apex seal well resists a sharp pressure rise in a combustion chamber to thereby prevent the blow-through of a combustion gas.

2 Claims, 6 Drawing Figures

APEX SEAL DEVICE FOR USE IN ROTARY PISTON ENGINE

BACKGROUND OF THE INVENTION

1. Field of the Invention

This invention relates to an apex seal device for use in a rotary piston engine, and more particularly to an apex seal specifically designed for preventing the blow-through of combustion gas from a combustion chamber into a suction chamber.

2. Description of the Prior Art

An apex seal for use in a rotary piston engine is attached to the crest of a rotor for sliding contact with the inner peripheral surface of a rotor housing of an engine, thereby maintaining air tightness between combustion chambers defined between the crests of the rotor and the inner peripheral surface of the rotor housing.

Accordingly, it is needless to mention that the apex seal should intimately contact the inner peripheral surface of the rotor housing. For this reason, the apex seal is loosely fitted within the seal groove defined in the apex or crest of the rotor in a radially movable manner, while there is provided a spring between the bottom surface of the seal groove and the apex seal for urging the apex seal against the inner peripheral surface of the rotor housing. In addition to this, the apex seal is urged in the same direction as above under a gas pressure in a combustion chamber, which pressure is introduced so as to act on the bottom of the seal groove.

However, the gas pressure acting on the bottom of a seal groove has some delay in timing, as compared with a rise in gas pressure in a combustion chamber. Thus, under the running condition of an engine having a combustion chamber which is encountered with a sharp or abrupt rise in the pressure, the gas pressure acting on the bottom of an apex seal fails to directly follow such a pressure rise, that part of combustion gas may blow around the tip of the apex seal into a suction chamber.

Hitherto, many attempts have been proposed to avoid such a shortcoming by providing slits and taper cuts in the side surfaces of the apex seal to thereby introduce a sufficient amount of gas from the combustion chamber onto the bottom surface of the apex seal, even if the apex seal is biased against the rotating direction of a rotor, due to the friction prevailing between the inner peripheral surface of the housing and the apex seal as well as due to the sharp or abrupt pressure rise within a combustion chamber. This, however, dictates the use of many man powers in manufacturing an apex seal which has the aforesaid slits or taper cuts, while failing to prevent the apex seal from being inclined. As a result, the blow-through of a combustion gas could not be prevented to satisfaction.

SUMMARY OF THE INVENTION

It is accordingly a principal object of the present invention to provide an apex seal device which may resist a sharp or abrupt pressure rise in a combustion chamber of a rotary piston engine to thereby prevent the blow-through of a high pressure combustion gas from a combustion chamber to a suction chamber.

According to the present invention, there is provided an apex seal device which comprises: an apex seal groove provided in a rotor and extending widthwise of said rotor and having a width constant in the radial direction; an apex seal movably fitted within said apex seal groove in the radial direction and having a bottom surface inclined to the horizontal direction in its cross section parallel with the rotating plane of said rotor; and an apex seal spring confined between the bottom surface of said apex seal groove and said inclined bottom surface of said apex seal, whereby the component of a force exerted by said spring in the direction perpendicular to the radial center line of said apex seal and the apex seal is biased against the radially extending wall surface of said apex seal groove on the side opposite to the rotating direction of said rotor, thus leaving a sufficient clearance between the wall surface of said groove opposing to the said firstly referred wall surface thereof and the side surface of said apex seal to introduce a combustion gas pressure through said clearance so as to cause said pressure to act on the inclined bottom of said seal groove.

DESCRIPTION OF THE PREFERRED EMBODIMENTS

Figure 1:
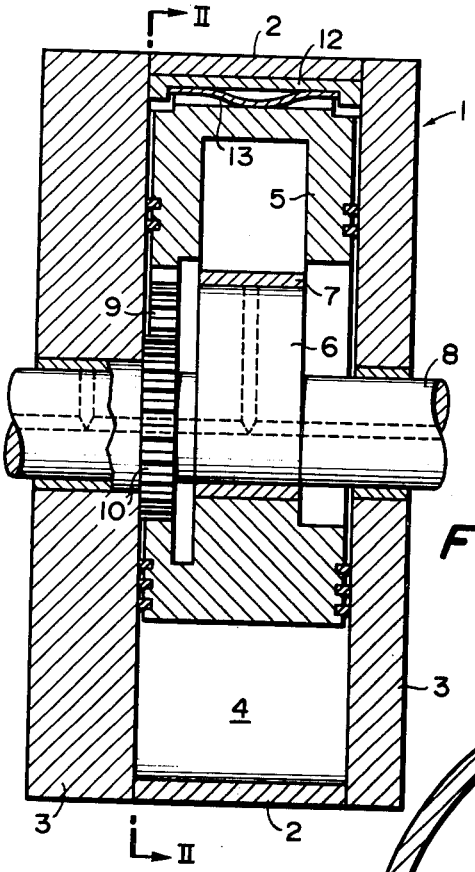
FIG. 1 is a cross-sectional view of a rotary piston engine having an apex seal device according to the present invention.

Referring now to FIG. 1, a rotor 5 in a rotary piston engine is rotatably mounted through the medium of bearings 7 on an eccentric shaft 6 within a casing 4 which consists of a rotor housing 2 and side housing 3.

The eccentric shaft 6 is integral with the output shaft 8 in an eccentric manner. The rotor 5 has a rotor gear 9 of the internal gear type, which gear 9 meshes with a fixed gear 10 rigidly provided in the side housings 2 in a concentric relation thereto. On the other hand, the rotor 5 has a substantially triangular shape and effects a planetary motion around the fixed gear 10 due to the meshing relation to the fixed gear 10, while sliding on the trochoidal inner peripheral surface of the rotor housing 2 and the side walls of the side housings 3.

Figure 2:
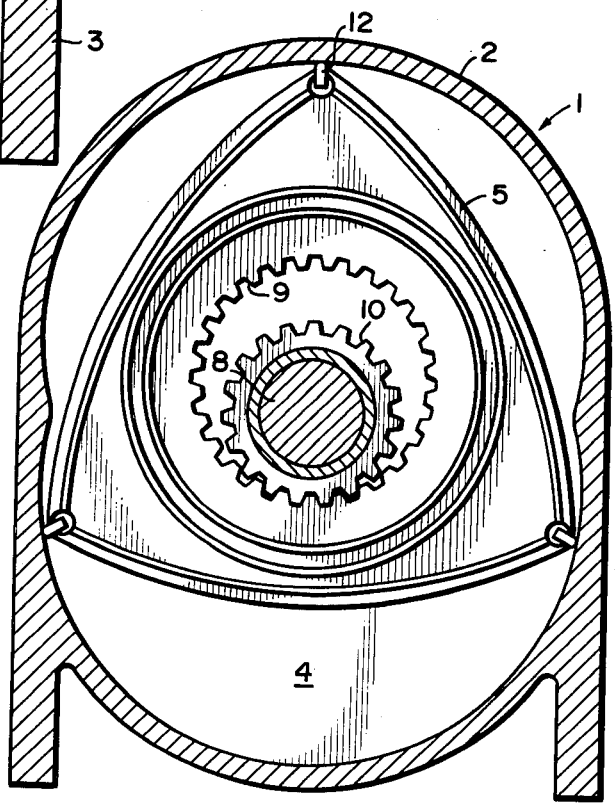
FIG. 2 is a cross-sectional view taken along the line II—II of FIG. 1.
Figure 3:
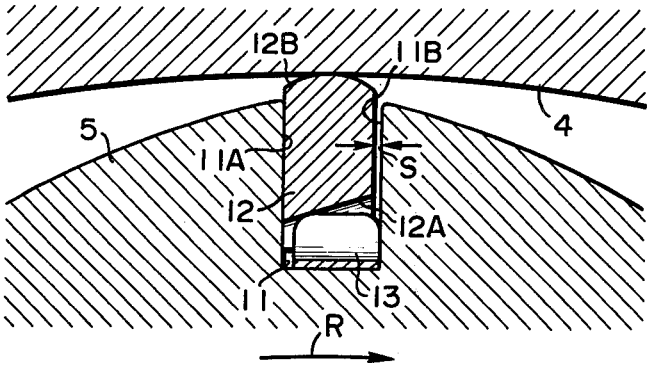
FIG. 3 is an enlarged, cross-sectional view of the essential part shown in FIG. 2.
Figure 4:
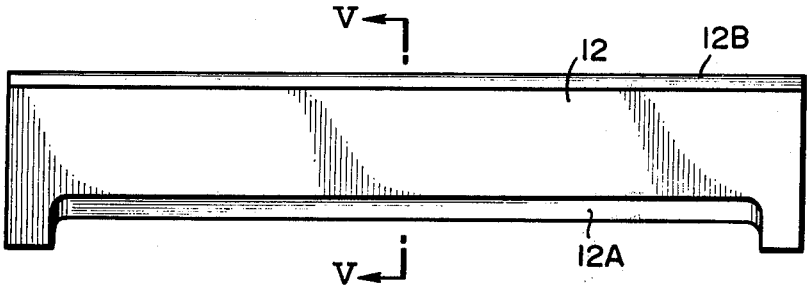
FIG. 4 is a side elevation of the apex seal according to the present invention.
Figure 5:
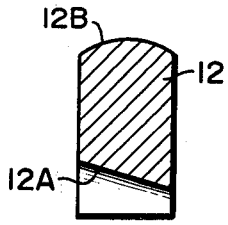
FIG. 5 is a cross-sectional view taken along the line V—V of FIG. 4.
Figure 6:
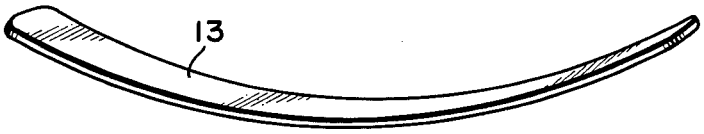
FIG. 6 is a perspective view of an apex seal spring.

At the tip portion of the apex of the rotor 5 of a triangular shape which slidingly contacts the inner peripheral surface of the rotor housing 2, there is provided a seal groove 11 extending through the rotor 5 crosswise or depthwise of the rotor 5 and having a width constant in the radial direction. As shown in FIG. 2 and FIG. 3, mounted in the groove 11 in radially sliding relation is an apex seal 12. As is best shown in FIG. 5, the bottom surface 12A of the apex seal 12 is inclined to the horizontal and plane making a right angle to the radius direction in relation to the apex seal 12 contacts the arcuate apex seal spring 13 (FIG. 6) provided within the seal groove 11. Thus, the apex seal is urged against the wall of the seal groove 11 located on the side opposite the rotating direction R of the rotor 5, by means of a horizontal component of a force of the spring 12 acting on the inclined bottom surface 12A, while being urged against the trochoidal inner peripheral surface 12B of the rotor housing 2 at the arcuate portion 12B by means of the vertical component of the force, as viewed in FIG. 3.

Accordingly, there will be defined a considerable amount of interstice or clearances between the side wall 11B of the seal groove 11 and the leading sidewall of the apex seal opposite to this side wall 11B, whereby a sufficient amount of gas under pressure may be introduced so as to act on the bottom portion of the apex seal 12, while there is insured a complete sealing between the adjoining chambers due to the apex seal thus urged. In addition, since the contacting point of the apex seal bottom surface 12A with the apex seal spring 13 is closer to the wall 11A of the groove on the side opposite the rotating direction of the rotor 5, the apex seal 12 is apt to be inclined, so that the apex seal may resist the friction between the apex seal and rotor housing as well as a sharp pressure rise in the combustion chamber, thereby preventing the blow-through of combustion gas from a combustion chamber to a suction chamber.

It should be noted that the present invention should not necessarily be limited to the aforesaid embodiments of the rotary piston engine, and is applicable to any type of rotor housings and rotors of engines.

As is apparent from the foregoing description, the present invention provides an apex seal device for use in a rotary piston engine, in which the apex seal has a bottom surface which is inclined with respect to the horizontal line and backed with the apex seal spring, whereby a component of a force of the apex seal spring acting on the aforesaid inclined bottom surface may act on the wall of the seal groove on the side opposite to the rotating direction of the rotor, so that the apex seal is tightly urged against the wall surface of said seal groove as well as against the inner peripheral surface of the rotor housing, thereby presenting complete sealing between the adjoining chambers. In addition, there is provided a considerable clearance on the other side wall of the seal groove so as to conveniently introduce a pressurized gas from the combustion chamber to the bottom portion of the apex seal. With this arrangement, however, the apex seal may resist a force to incline the apex seal, thus preventing the blow-through of combustion gas from one chamber to another.

It will be understood that the above description is merely illustrative of preferred embodiments of the invention. Additional modifications and improvements utilizing the discoveries of the present invention can be readily anticipated by those skilled in the art from the present disclosure, and such modifications and improvements may fairly be presumed to be within the scope and purview of the invention as defined by the claims that follow.

What is claimed is:

1. In a rotary piston engine of the type comprising a rotor, an apex seal groove provided in a crest portion of said rotor, a rotor housing, and an apex seal device, the improvement comprising:

an apex seal movably located within said apex seal groove in the radial and rotational directions, said seal having a bottom surface inclined to a horizontal plane making a right angle to the radius direction in relation to said apex seal, said apex seal further having an interstice between the leading side wall of said apex seal and the inside wall of said apex seal groove opposite to the leading side wall of said apex seal; and an apex seal spring confined between the bottom surface of said apex seal groove and said bottom surface of said apex seal, said spring contacting said inclined bottom surface of said apex seal, at only a point nearer the trailing side wall of said apex seal than the leading side wall of said apex seal whereby the trailing side wall of said apex seal is not only urged against the inside wall of said apex seal groove opposite to the trailing side wall of said apex seal but also inclined against the direction of rotation of the rotor thereby preventing blow-through of combustion gas from a combustion chamber to a suction chamber.

2. An apex seal device as set forth in claim 1, wherein the contacting point of said spring with said inclined bottom surface is biased in the direction opposite to the rotating direction of said rotor with respect to the radial center line of said apex seal.

* * * * *